United States Patent [19]

Kramer

[11] 4,253,408

[45] Mar. 3, 1981

[54] METHOD OF PROTECTING INCINERATOR SURFACES

[75] Inventor: Irvin R. Kramer, Baltimore, Md.

[73] Assignee: The United States of America as represented by the Secretary of the Navy, Washington, D.C.

[21] Appl. No.: 69,194

[22] Filed: Aug. 24, 1979

[51] Int. Cl.[3] ..... F23J 1/00

[52] U.S. Cl. ..... 110/346; 110/219; 110/238; 110/343

[58] Field of Search ..... 110/219, 238, 343, 346, 110/342

[56] References Cited

U.S. PATENT DOCUMENTS

| | | | |
|---|---|---|---|
| 2,800,172 | 7/1957 | Romer et al. | 110/343 X |
| 3,888,193 | 6/1975 | Kishigami et al. | 110/346 X |
| 3,921,543 | 11/1975 | Menigat et al. | 110/346 X |
| 4,159,683 | 7/1979 | Hughes et al. | 110/343 |

*Primary Examiner*—Edward G. Favors

*Attorney, Agent, or Firm*—R. S. Sciascia; L. A. Marsh; W. W. Randolph

[57] ABSTRACT

A method of preventing corrosion of incinerators designed to burn sewage consisting essentially of from about 90 to 98 percent water and from about 2 to 10 percent waste solids by increasing the fusion temperature range of the ash product above the operating temperature of the interior surfaces of the incinerator. The sewage is mixed with additive materials selected from the group $SiO_2$, CaO, $Al_2O_3$, MgO wherein the CaO, $Al_2O_3$ and MgO are selected from within the range of 10 to 30 percent of the weight of the waste solids and the $SiO_2$ is selected from within the range of 25 to 30 percent of the weight of the waste solids. Thereafter, the sewage-additive mixture is injected or otherwise dispersed into the combustion zone of an incinerator such that the waste solids and additive particles remain in contact therein for sufficient time for the additives to chemically combine with sewage solids and form combustion products having fusion temperatures ranges above the operating temperatures of the incinerator surfaces.

4 Claims, No Drawings

METHOD OF PROTECTING INCINERATOR SURFACES

The invention described herein may be manufactured and used by or for the Government of the United States of America for governmental purposes without the payment of any royalties thereon or therefor.

BACKGROUND OF THE INVENTION

This invention relates generally to the prevention of corrosion of refractory and metal surfaces. More particularly, this invention has special application to incinerators and a method of inhibiting corrosion of incinerator elements by introducing additives to sewage and waste products burned therein.

Incineration of sewage and other waste materials including combustible chemicals and oils is used in many places where other forms of disposal are precluded. Generally, incineration of wastes allows the advantageous use of relatively compact, lightweight treatment units and greatly reduces the volume and weight of the end products. Thus, incinerators find particular application in ships and marine vessels. As opposed to land based incinerators, which are normally designed to burn a different character of waste products and often contain heavy ceramic refractory linings, shipboard incinerators tend to be smaller, usually have metal lined refractory surfaces to effect weight reduction as exemplified by U.S. Pat. No. 3,861,330 and are often operated at higher liner or wall temperatures than such land based incinerators.

Waste products commonly disposed of in shipboard incinerators include sewage mixed with oily residues, seawater and various other chemical compounds. Normally, the combustion of such products produces ash products which if they undergo partial or complete fusion in the combustion zones become sufficiently soft, plastic or molten enough to adhere to the internal surfaces of the incinerators. Such an occurrence produces results which tend to adversely affect the efficient performance of incinerators. For example, the accumulation of molten ash or slag on heat exchange surfaces tends to reduce the heat absorbing ability thereof and continued accumulation of molten combustion products often clogs various flow paths, thereby reducing the flow and perhaps raising the temperature of the combustion products. Importantly, it was found that combustion products in a molten or liquid state react much more rapidly with interior surfaces of incinerators than when in the solid state and, as a consequence, promote more rapid corrosion. Accordingly, it was desirable to cause the combustion products to exist in a solid phase at the incinerator interface, thereby reducing the reaction rate with the incinerator surfaces without reducing the operating temperatures of the incinerators. This is particularly critical with incinerators designed to burn shipboard wastes, which typically contain sewage having about a 95% water content wherein a minimum operating temperature is normally required to evaporate the water content and burn the waste solids in a relatively short period of time. The chemical structure of the compounds found in the solid waste or fecal matter is unknown in general because of the variable and complex nature of sewage.

The teachings of the following references are primarily concerned with additives for decreasing the deleterious effect of impurities in the fuel oils: British Pat. Nos. 496,692; 728,812; 878,723; Canadian Pat. Nos. 619,117; 714,846; and U.S. Pat. Nos. 2,800,172; 2,844,112. Designed to clean up the fuel oils, the additives are normally introduced directly into the fuel such that reactions with the undesirable impurties in the fuel can occur during the combustion process. In contrast, the process of the present invention relates to the incineration of shipboard wastes consisting essentially of about 95% water and about 5% solids of chemically complex constituents, wherein the additives are intended to react therewith. In view of the limited reaction times in the present process, as short as one second with some incinerators, it can be appreciated that proper combustion of the waste solids requires controlled dispersion of the waste mixture into the combustion zone so that the additives remain in contact with the waste solids, wherein reactions between the additives and the impurities in the fuel are of negligible importance.

Additionally, the following references generally relate to fluidized bed processes wherein the chemical reaction time is often relatively long as compared with many incineration processes; U.S. Pat. Nos. 3,881,430; 3,888,193; 3,888,194; 3,921,543 and 4,060,041. In view such relatively long contact times, additives are commonly introduced into the fluidized bed materials to prevent such bed materials from sticking together and sintering, to remove noxious and toxic gasses by reaction therewith and to act as reaction catalysts; but such additives are not primarily intended to inhibit or prevent corrosion of the walls of the reaction chamber. As aforementioned, the process of the present invention is designed for the combustion of wastes having a high water content wherein the reaction period is relatively brief.

Examples of incinerator structures are generally disclosed in U.S. Pat. Nos. 3,805,714; 3,861,330; 3,892,190 and 4,002,147. In the incineration of aqueous waste containing organic material and other solids, it is preferred that such solid waste material is finely dispersed and suspended in a liquid slurry prior to introduction into the combustion zone. Common means for introducing the liquid waste slurry into the combustion zone includes conventional conduits and liquid lines with pressure sources connected thereto such that the waste slurry is directed through injection nozzles of various design. Upon introduction into the combustion zone, the sudden expansion of the waste slurry into a larger volume produces a relatively large effective reaction surface for rapid evaporation of the water and combustion of the waste solids. The turbulence created by the injection of the waste slurry into the combustion zones and the directional flow pattern of gasses in the combustion zones promotes rapid incineration of the waste solids. This is particularly relevant in view of the fact that the reaction and retention periods of waste products in the combustion zones of some incinerators is on the order of a few seconds. Customarily, the operating temperatures of the walls of the incinerators are lower than the flame or combustion temperatures occurring in the combustion zones of the incinerators.

SUMMARY OF THE INVENTION

Accordingly, in view of the aforementioned combustion conditions, it is a general object of the present invention to prevent corrosion of incinerator surfaces by introducing additives into the aqueous wastes to prevent or inhibit the decomposition ash product of the waste material from forming a liquid phase adjacent the incinerator surfaces.

A further object of the present invention is to introduce sufficient additive to suitable increase the fusion temperature range of substantially all of the decomposition product of the waste materials yet limit such additions within proportional ranges such that surplus additives are not counterproductive to the chemical combustion reactions during the relatively short reaction times.

These and other objects of this invention are met by mixing one or more additive materials selected from the group $SiO_2$, CaO, $Al_2O_3$, MgO with sewage and dispersing the sewage-additive mixture into a combustion zone of an incinerator such that the sewage solids and additive particles are maintained in contact. The sewage solids and additive particles are retained in contact within the combustion zone of a sufficient time for the additives to chemically combine with the waste solids so that the ash product formed by the combustion of the waste solids and additive particles has a range of fusion temperatures above the operating temperature of the incinerator surfaces.

DETAILED DESCRIPTION OF THE INVENTION

Incinerators currently being employed by the U.S. Navy for burning shipboard waste products include ceramic-lined multipurpose incinerators and metal-lined incinerators of the type shown by U.S. Pat. No. 3,861,330. It was observed that deterioration of shipboard incinerators, which commonly operate with wall temperatures of about 1600° F. and perhaps within a temperature range of from about 1400° F. to 1700° F., was due to the corrosive environment produced by combustion of human excrement, saltwater and lasser amounts of other wastes. Softening point studies of the ash formed by the decomposition of human waste were initiated to determine the feasibility of introducing additives to the waste solids to produce combustion products having a stable, solid ash. Although scientific examination of the ash constituents of wastes commonly incinerated aboard ships revealed the presence of aluminum, calcium, chlorine, magnesium, phosphorous, silicon, sodium, and sulfur, specific identification of particular compounds was not possible in view of the fact that the ash aggregate is formed by complex chemical reactions during the decomposition of the human waste in the flame. However, it was deduced that the type of compounds which appeared to be present in the ash included: (1) phosphates, most likely complex calcium-base compounds; (2) chlorides based on potassium and sodium compounds; and (3) sulfates based on potassium and sodium compounds, wherein the structure and composition of the compounds is unknown.

Thereafter, the effects were determined of mixing various additives, such as $SiO_2$, $Al_2O_3$, CaO, MgO, $CaCO_3$ and combinations thereof with actual waste products burned within a combustion flame at temperatures of about 2400° F. in a shipboard incinerator of the general type disclosed in U.S. Pat. No. 3,861,330. For example, additions of $SiO_2$ were made in 5% increments from 5% to 30% of the weight of the waste solids and the effects of some additions, such as MgO, CaO plus MgO and $CaCO_3$, were observed at temperatures above 1900° F. More specifically, for example, with additions of CaO at 5% and 10% of the weight of the waste solids it was observed that addition the 10% proportion resulted in retention of essentially all of the major elemental constituents except chlorine at temperatures up to 2150° F. and that sulfur containing compounds were converted into nonvolatile compounds at temperatures between 1700° F. to 1900° F. Additional experiments were made by mixing the additives in weighted proportions with synthetic urine which included the following known constituents:

| Synthetic Urine | |
|---|---|
| urea | 3.5(grams) |
| $(NH_4)_2 SO_4$ | 3.67 |
| $MgCl_2 . 6H_2O$ | 1.67 |
| $NaH_2PO_4 . 1H_2O$ | 4.9 |
| $K_2SO_4$ | 4.5 |
| $CaCl_2$ | 1.11 |
| NaCl | 9.11 |

With respect to the various additives used in the experimental tests, the following results were observed:

1. Additions of $SiO_2$, $Al_2O_3$, and MgO all increased the softening and melting points within the range of additions investigated, additive weight from 5% to 30% of the weight of the waste solids. While 5% additions of CaO, MgO and $Al_2O_3$ provided measurable increase in softening point, 10% additions appear to be the minimum amount necessary for significant fusion temperature increases of the ash product;
2. Calcium oxide, CaO, was the most efficient additive in increasing the softening point of various ash products to 2200° F. for a 10% addition;
3. Silica additions had little or no effect on ash softening points for 10% to 20% additions, but substantially increased the softening points of ash products of the shipboard wastes for an additive range of from 25% to 30% of the weight of the waste solids;
4. Additions of 15% $SiO_2$ in combination with 5% and 10% $Al_2O_3$ and CaO were no more effective than $Al_2O_3$ and CaO added alone; and
5. Additions of 5% and 10% proportions of $Al_2O_3$ and MgO were more effective than similar proportions of $SiO_2$, but were less effective than CaO and $CaCO_3$ in increasing the ash softening points.

Experimentally it was found that employing additives in excess of 30% of the weight of the waste solids did not produce significant improvements in the softening points and fusion temperatures of the ash product. At proportions higher than 30% of the waste solids it became moe difficult to homogeneously mix the additives with the waste solids and such excess additives tended to unnecessarily extract heat from the combustion system.

Accordingly, the method of preventing corrosion of metal-lined incinerators which burn sewage and other waste effluent generally comprises the steps of mixing additives containing one or more of $SiO_2$, CaO, $Al_2O_3$ and MgO, in amounts which range from 10 to 30 percent of the weight of the waste solids for CaO, $Al_2O_3$ and MgO and from 25 to 30 percent of the weight of waste solids for $SiO_2$, with sewage consisting essentially of from about 90 to 98 percent water and from about 2 to 10 percent waste solids. The additive is uniformly dispersed within the mixture such that when the mixture is injected under pressure into a heat or combustion zone and widely dispersed therein, the additive particles remain in contact with the waste solids, probably as a result of surface tension. The mixture is maintained in the heat or combustion zones for sufficient time, normally from about one-half to three seconds, for the additives to chemically combine with the waste solids such that the additives effect an increased fusion temperature range of the combustion products. Such occurrence thereby prevents reaction of the combustion products in a liquid state with the liners of incinerators during normal operating temperatures. Further, since many incinerators are normally used only when there is a demand for sewage disposal, such as when the holding tanks are full, the incinerator process is most likely to be of a cyclic nature with periodic shutdowns, so that the coalescence and caking of molten ash products on the walls of the incinerator would produce more ash buildup than if the ash products were in a solid state.

Normally, sewage and other waste materials to be disposed of in incinerators are collected in holding tanks and maintained in a stirred or mixed condition therein until the waste materials reach a predetermined level. Thereafter, pumps transfer the liquid waste slurry under pressure to the incinerator wherein it is commonly injected therein. The pressurized fluid causing the sludge to pass from the holding tank to the incinerator is preferably compressed air, but steam, gases or other fluids may be used which will not impede the flow or eventual combustion of the waste materials. Compressed air has the additional advantage of increasing the available oxygen in the combustion chamber and serves to promote more complete combustion of the waste solids and gases in the combustion zones of the incinerators. The pressurized fluid or air also serves to automatically clean the orifices of the injection nozzles of waste solids and other debris. As a result of the increased velocity of the liquid waste slurry as it passes through such restrictive nozzle orifices, an atomized mist is dispersed therefrom into the combustion chamber. As aforementioned, the sudden expansion of the waste slurry into the combustion zone produces a large effective reaction surface for rapid evaporation of the water and combustion of the waste solids. The additives are normally finely ground to a powdery consistency and mixed with an appropriate liquid to form a liquid slurry. The liquid slurry mixture is thereafter introduced into the waste conduits transferring the liquid waste slurry from the holding tank to the incinerator such that the additive particles are in contact with the waste solids and remain so after introduction into the combustion chamber. It is within the scope of this invention that chemicals may be added to the additives to promote and maintain adhesion between the waste solids and the additive particles. In view of the turbulent conditions existing within the combustion zones of various incinerators, it is unlikely that separate introduction of the wastes and additives into the combustion zones and dependency upon subsequent collision between the waste solids and additive particles would produce similar desired results. It is also unlikely that the desired results would be obtained if the additives were introduced into the fuel. In this case the additives would first react with the various impurities in the fuel and would not be available for further chemical reactions with the waste material.

Obviously many modifications and variations of the present invention are possible in light of the above teachings. It is therefore to be understood that within the scope of the appended claims, the invention may be practiced otherwise than as specifically claimed.

Which is claimed is:

1. A method of increasing the fusion temperatures of combustion products formed during the incineration of sewage comprising the steps of:

mixing one or more additive materials selected from the group $SiO_2$, CaO, $Al_2O_3$, MgO with sewage consisting essentially of from about 90 to 98 percent water and from about 2 to 10 percent sewage solids, wherein the combined weight of the additives is not greater than 30 percent of the weight of the sewage solids, with the CaO, $Al_2O_3$ and MgO being selected from within the range of 10 to 30 percent of the weight of the sewage solids and $SiO_2$ being selected from within the range of 25 to 30 percent of the weight of the sewage solids;

maintaining said additive materials uniformly dispersed within the sewage-additive mixture;

dispersing said sewage-additive mixture into a combustion zone of an incinerator such that the sewage solids and additive particles are maintained in contact;

retaining the additives and sewage solids in contact within a combustion zone of an incinerator for sufficient time for the additives to chemically combine with the waste solids so that the ash product formed by the combustion of the waste solids and additives has an increased range of fusion temperatures above the operating temperatures of the incinerator walls.

2. The method according to claim 1, wherein the sewage solids and additive particles are retained in a combustion zone of an incinerator for less than about three seconds.

3. A method of preventing corrosion of surfaces of incinerators designed to burn sewage by raising the fusion temperature of the sewage ash products above the operating temperatures of the incinerator surfaces comprising the steps of:

mixing additives containing one or more of $SiO_2$, CaO, $Al_2O_3$, MgO with sewage consisting essentially of from about 90 to 98 percent water and from about 2 to 10 percent solids, wherein the combined weight of the additives is not less than 10 percent nor greater than 30 percent of the weight of the sewage solids;

injecting the sewage-additive mixture under pressure into a combustion zone of an incinerator such that the sewage solids and additive particles remain in contact during incineration;

incinerating the sewage-additive mixture for sufficient time for the additives to chemically combine with the combustion products formed by the decomposition of the sewage solids to form an ash product having a fusion temperature above the operating wall temperatures of the incinerator.

4. The method according to claim 3 wherein the operating wall temperatures of the incinerator range from about 1400° F. to about 1700° F.

* * * * *